US009206611B2

(12) United States Patent
Vermeulen et al.

(10) Patent No.: US 9,206,611 B2
(45) Date of Patent: Dec. 8, 2015

(54) FLOOR PANEL ASSEMBLY AND FLOOR PANEL FOR USE THEREIN

(75) Inventors: Bruno Paul Louis Vermeulen, Aldeneik-Maaseik (BE); Jan Eddy De Rick, Geraardsbergen (BE)

(73) Assignee: Spanolux N.V.—Div. Balterio, Sint-Baafs-Vijve (BE)

( * ) Notice: Subject to any disclaimer, the term of this patent is extended or adjusted under 35 U.S.C. 154(b) by 0 days.

(21) Appl. No.: 13/548,420

(22) Filed: Jul. 13, 2012

(65) Prior Publication Data

US 2013/0008119 A1 Jan. 10, 2013

Related U.S. Application Data

(63) Continuation of application No. PCT/EP2010/054993, filed on Apr. 15, 2010.

(30) Foreign Application Priority Data

Jan. 14, 2010 (EP) ..... 10150796

(51) Int. Cl.
*E04F 15/02* (2006.01)
*E04B 5/02* (2006.01)

(52) U.S. Cl.
CPC ..... *E04F 15/02038* (2013.01); *E04B 5/023* (2013.01); *E04F 15/02* (2013.01);
(Continued)

(58) Field of Classification Search
CPC ..... E04F 2201/0138; E04F 15/02; E04F 15/02005; E04F 2201/05; E04F 13/0801; E04B 5/02; E04B 5/023
USPC ..... 52/588.1, 582.1, 582.2, 586.1, 586.2, 52/591.1, 592.1, 309.1, 309.13
See application file for complete search history.

(56) References Cited

U.S. PATENT DOCUMENTS 6,505,452 B1 1/2003 Hannig et al.
6,591,568 B1 7/2003 Palsson
(Continued)

FOREIGN PATENT DOCUMENTS

BE 557844 A 6/1957
BE 1018712 A3 7/2011
(Continued)

OTHER PUBLICATIONS

European Search Report and the Written Opinion of the European Patent Office Patent Office in counterpart foreign application PCT/EP2010/054993 filed Apr. 15, 2010.
(Continued)

*Primary Examiner* — Phi A
(74) *Attorney, Agent, or Firm* — Steven M. Koehler; Westman, Champlin & Koehler, P.A.

(57) ABSTRACT

A floor panel assembly includes sheet-shaped floor panels joinable by joining members, each panel being provided on a first edge with a first joining member and, on a second edge, with a second joining member. The first and second joining members of two panels are configured to be joined by a movement of the panels towards to each other. The joining members lock the panels vertically and horizontally. The joining members are provided with a locking element which is deformable, during said joining, from a first position allowing the joining members to be joined, to a second position in which it locks the joining members to each other at least horizontally.

34 Claims, 12 Drawing Sheets

(52) U.S. Cl.
CPC . *E04F2201/0138* (2013.01); *E04F 2201/0146* (2013.01); *E04F 2201/0153* (2013.01); *E04F 2201/0176* (2013.01); *E04F 2201/0523* (2013.01)

(56) References Cited

U.S. PATENT DOCUMENTS

| | | | | |
|---|---|---|---|---|
| 6,647,690 | B1 | 11/2003 | Martensson | |
| 6,769,219 | B2 | 8/2004 | Schwitte et al. | |
| 6,804,926 | B1 | 10/2004 | Eisermann | |
| 6,854,235 | B2 | 2/2005 | Martensson | |
| 7,065,935 | B2 | 6/2006 | Ralf | |
| 7,121,058 | B2 | 10/2006 | Palsson | |
| 7,332,053 | B2 | 2/2008 | Palsson et al. | |
| 7,451,578 | B2 | 11/2008 | Hannig | |
| 7,454,875 | B2 * | 11/2008 | Pervan et al. | 52/586.2 |
| 7,603,826 | B1 | 10/2009 | Moebus | |
| 7,634,884 | B2 * | 12/2009 | Pervan et al. | 52/582.1 |
| 7,637,068 | B2 * | 12/2009 | Pervan | 52/592.1 |
| 7,726,088 | B2 * | 6/2010 | Muehlebach | 52/582.1 |
| 7,757,452 | B2 * | 7/2010 | Pervan | 52/586.1 |
| 7,802,411 | B2 * | 9/2010 | Pervan et al. | 52/586.2 |
| 7,841,144 | B2 * | 11/2010 | Pervan | 52/395 |
| 7,866,110 | B2 * | 1/2011 | Pervan | 52/586.2 |
| 7,908,815 | B2 * | 3/2011 | Pervan et al. | 52/582.1 |
| 7,980,039 | B2 * | 7/2011 | Groeke et al. | 52/582.2 |
| 7,980,041 | B2 * | 7/2011 | Pervan et al. | 52/586.2 |
| 8,033,074 | B2 * | 10/2011 | Pervan et al. | 52/582.1 |
| 8,042,311 | B2 * | 10/2011 | Pervan et al. | 52/586.1 |
| 8,079,196 | B2 * | 12/2011 | Pervan | 52/586.2 |
| 8,112,967 | B2 * | 2/2012 | Pervan et al. | 52/747.11 |
| 8,181,416 | B2 * | 5/2012 | Pervan et al. | 52/586.2 |
| 8,220,217 | B2 * | 7/2012 | Muehlebach | 52/582.1 |
| 8,234,830 | B2 * | 8/2012 | Pervan et al. | 52/588.1 |
| 8,302,367 | B2 | 11/2012 | Schulte | |
| 8,353,140 | B2 | 1/2013 | Pervan et al. | |
| 8,365,499 | B2 | 2/2013 | Nilsson et al. | |
| 8,381,477 | B2 | 2/2013 | Pervan et al. | |
| 2004/0068954 | A1 | 4/2004 | Martensson | |
| 2004/0211143 | A1 * | 10/2004 | Hanning | 52/578 |
| 2005/0005972 | A1 | 1/2005 | Borg | |
| 2007/0006543 | A1 * | 1/2007 | Engstrom | 52/582.1 |
| 2007/0175156 | A1 * | 8/2007 | Pervan et al. | 52/582.1 |
| 2008/0066415 | A1 * | 3/2008 | Pervan et al. | 52/588.1 |
| 2008/0110125 | A1 * | 5/2008 | Pervan | 52/582.2 |
| 2008/0134607 | A1 * | 6/2008 | Pervan et al. | 52/395 |
| 2008/0134613 | A1 * | 6/2008 | Pervan | 52/582.2 |
| 2008/0134614 | A1 * | 6/2008 | Pervan et al. | 52/588.1 |
| 2008/0155930 | A1 * | 7/2008 | Pervan et al. | 52/588.1 |
| 2009/0064624 | A1 | 3/2009 | Sokol | |
| 2009/0100782 | A1 | 4/2009 | Groeke et al. | |
| 2009/0217615 | A1 * | 9/2009 | Engstrom | 52/588.1 |
| 2009/0308014 | A1 | 12/2009 | Muehlebach | |
| 2010/0043333 | A1 * | 2/2010 | Hannig | 52/582.2 |
| 2010/0281803 | A1 * | 11/2010 | Cappelle | 52/309.1 |
| 2010/0300031 | A1 * | 12/2010 | Pervan et al. | 52/588.1 |
| 2011/0030303 | A1 * | 2/2011 | Pervan et al. | 52/582.1 |
| 2011/0088345 | A1 * | 4/2011 | Pervan | 52/588.1 |
| 2011/0167750 | A1 * | 7/2011 | Pervan | 52/588.1 |
| 2011/0167751 | A1 * | 7/2011 | Engstrom | 52/588.1 |
| 2011/0173914 | A1 * | 7/2011 | Engstrom | 52/582.2 |
| 2011/0252733 | A1 * | 10/2011 | Pervan et al. | 52/309.1 |
| 2011/0271631 | A1 * | 11/2011 | Engstrom | 52/582.2 |
| 2011/0271632 | A1 * | 11/2011 | Cappelle et al. | 52/582.2 |
| 2011/0283650 | A1 * | 11/2011 | Pervan et al. | 52/588.1 |
| 2012/0011796 | A1 * | 1/2012 | Hannig | 52/588.1 |
| 2012/0031029 | A1 * | 2/2012 | Pervan et al. | 52/309.13 |
| 2012/0036804 | A1 * | 2/2012 | Pervan | 52/309.13 |
| 2012/0055112 | A1 * | 3/2012 | Engstrom | 52/582.2 |
| 2012/0124932 | A1 * | 5/2012 | Schulte et al. | 52/588.1 |
| 2012/0174515 | A1 * | 7/2012 | Pervan et al. | 52/309.1 |
| 2012/0174521 | A1 * | 7/2012 | Schulte | 52/588.1 |
| 2013/0025231 | A1 | 1/2013 | Vermeulen | |
| 2013/0276398 | A1 | 10/2013 | Hannig | |

FOREIGN PATENT DOCUMENTS

| | | | |
|---|---|---|---|
| CL | 562377 | A5 | 5/1975 |
| DE | 2502992 | A1 | 7/1976 |
| DE | 3046618 | A1 | 7/1982 |
| DE | 3932980 | A1 | 11/1991 |
| DE | 4344089 | A1 | 7/1994 |
| DE | 29614086 | U1 | 11/1996 |
| DE | 29911462 | U1 | 12/1999 |
| DE | 20000484 | U1 | 6/2000 |
| DE | 20008708 | U1 | 10/2000 |
| DE | 19929896 | A1 | 1/2001 |
| DE | 19933343 | A1 | 2/2001 |
| DE | 10001076 | C1 | 10/2001 |
| DE | 29924169 | U1 | 7/2002 |
| DE | 10224540 | A1 | 12/2003 |
| DE | 29924582 | U1 | 1/2004 |
| DE | 10237397 | A1 | 2/2004 |
| DE | 10252864 | A1 | 5/2004 |
| DE | 10253236 | A1 | 5/2004 |
| DE | 10305695 | A1 | 9/2004 |
| DE | 102004001363 | A1 | 8/2005 |
| DE | 102005002297 | A1 | 8/2005 |
| DE | 102004015604 | B4 | 11/2005 |
| DE | 102006011887 | A1 | 7/2007 |
| DE | 102007019786 | A1 | 6/2008 |
| DE | 102007018309 | A1 | 8/2008 |
| DE | 102007020271 | | 8/2008 |
| DE | 102007015907 | A1 | 10/2008 |
| DE | 102007017087 | A1 | 10/2008 |
| DE | 202009004530 | U1 | 6/2009 |
| DE | 102008018410 | B3 | 11/2009 |
| DE | 102008021970 | A1 | 11/2009 |
| DE | 202004021628 | | 12/2009 |
| DE | 102004055951 | B4 | 8/2010 |
| DE | 102010012572 | B3 | 7/2011 |
| EP | 0085196 | A1 | 1/1982 |
| EP | 0715037 | A1 | 11/1995 |
| EP | 1119671 | B1 | 9/1999 |
| EP | 1159497 | | 9/1999 |
| EP | 1304427 | B1 | 9/1999 |
| EP | 1394336 | A2 | 9/1999 |
| EP | 1190149 | B1 | 10/1999 |
| EP | 1200690 | B1 | 3/2000 |
| EP | 1120515 | A1 | 4/2000 |
| EP | 1282752 | B1 | 6/2000 |
| EP | 1246981 | B1 | 1/2001 |
| EP | 1722042 | A1 | 1/2001 |
| EP | 1276941 | B1 | 2/2001 |
| EP | 2009195 | A2 | 2/2001 |
| EP | 1279778 | A2 | 7/2002 |
| EP | 1415056 | B1 | 7/2002 |
| EP | 1669512 | | 7/2002 |
| EP | 1953309 | | 7/2002 |
| EP | 1420125 | A2 | 3/2003 |
| EP | 1350904 | B1 | 4/2003 |
| EP | 1359266 | A2 | 4/2003 |
| EP | 1367194 | A2 | 5/2003 |
| EP | 1380710 | A2 | 6/2003 |
| EP | 1650375 | B1 | 10/2004 |
| EP | 1936068 | | 10/2004 |
| EP | 1559523 | B1 | 1/2005 |
| EP | 1582653 | B1 | 3/2005 |
| EP | 1802827 | A1 | 10/2005 |
| EP | 2281972 | A2 | 10/2005 |
| EP | 1674223 | B1 | 12/2005 |
| EP | 1923184 | B1 | 12/2005 |
| EP | 1929103 | | 7/2006 |
| EP | 2305919 | A2 | 7/2006 |
| EP | 2395179 | A2 | 7/2006 |
| EP | 2049749 | B1 | 8/2007 |
| EP | 2034106 | A1 | 9/2008 |
| EP | 1987212 | | 11/2008 |
| EP | 2270291 | B1 | 6/2009 |
| EP | 2236694 | | 10/2010 |
| EP | 2520737 | A1 | 5/2011 |
| FR | 1522094 | A1 | 3/1968 |
| FR | 2278876 | A1 | 2/1976 |
| JP | 7300979 | A | 11/1995 |

(56) References Cited

FOREIGN PATENT DOCUMENTS

| | | | |
|---|---|---|---|
| WO | WO0020706 | | 4/2000 |
| WO | WO0047841 | A1 | 8/2000 |
| WO | WO0063510 | A1 | 10/2000 |
| WO | WO0102669 | A1 | 1/2001 |
| WO | WO0151732 | A1 | 7/2001 |
| WO | WO0151733 | A1 | 7/2001 |
| WO | WO0175247 | A1 | 10/2001 |
| WO | WO0188306 | A1 | 11/2001 |
| WO | WO0198604 | A1 | 12/2001 |
| WO | WO03016654 | A1 | 2/2003 |
| WO | WO03083234 | A1 | 10/2003 |
| WO | WO2004016876 | A2 | 2/2004 |
| WO | WO2005003489 | A1 | 6/2004 |
| WO | WO2005068746 | A1 | 7/2005 |
| WO | WO2006043893 | A1 | 4/2006 |
| WO | WO2006125306 | A1 | 11/2006 |
| WO | WO2006133690 | A1 | 12/2006 |
| WO | WO2007008139 | A1 | 1/2007 |
| WO | WO2007015669 | A2 | 2/2007 |
| WO | WO2007020088 | A1 | 2/2007 |
| WO | WO2007053983 | A1 | 5/2007 |
| WO | WO2007079845 | A1 | 7/2007 |
| WO | WO2007089186 | | 8/2007 |
| WO | WO2007141605 | A2 | 12/2007 |
| WO | WO2008004960 | A2 | 1/2008 |
| WO | WO2008060232 | A1 | 5/2008 |
| WO | WO2008083662 | A1 | 7/2008 |
| WO | WO2008110112 | A1 | 9/2008 |
| WO | WO2008116623 | A1 | 10/2008 |
| WO | WO2008122479 | A1 | 10/2008 |
| WO | WO2009021487 | A1 | 2/2009 |
| WO | WO2009033623 | A1 | 3/2009 |
| WO | WO2009061279 | A1 | 5/2009 |
| WO | WO2009077178 | A1 | 6/2009 |
| WO | WO2009116926 | A1 | 9/2009 |
| WO | WO2010001262 | A2 | 1/2010 |
| WO | WO2010017453 | A2 | 2/2010 |
| WO | WO 2010/082171 | A2 | 7/2010 |
| WO | WO2010081532 | A1 | 7/2010 |
| WO | WO2010082171 | A2 | 7/2010 |
| WO | WO2010086084 | A1 | 8/2010 |
| WO | WO2010087752 | A1 | 8/2010 |
| WO | WO2011001326 | A2 | 1/2011 |
| WO | WO2011012104 | A2 | 2/2011 |
| WO | WO2011012105 | A1 | 2/2011 |
| WO | WO2011032540 | A2 | 3/2011 |
| WO | WO2011038709 | A1 | 4/2011 |
| WO | WO2011061659 | A2 | 5/2011 |
| WO | WO2011085788 | A1 | 7/2011 |
| WO | WO2011087425 | A1 | 7/2011 |
| WO | WO2011108812 | A2 | 9/2011 |
| WO | WO2011127981 | A1 | 10/2011 |
| WO | WO2011157752 | A1 | 12/2011 |

OTHER PUBLICATIONS

European Search Report and the Written Opinion of the European Patent Office Patent Office in foreign application PCT/EP2010/054992 filed Apr. 15, 2010.

* cited by examiner

FLOOR PANEL ASSEMBLY AND FLOOR PANEL FOR USE THEREIN

CROSS-REFERENCE TO RELATED APPLICATION

The present application is a continuation and claims priority of International patent application Serial No. PCT/EP2010/054993, filed Apr. 15, 2010, and published as WO 2011/085825 in English, which is incorporated herein by reference in its entirety.

BACKGROUND

The discussion below is merely provided for general background information and is not intended to be used as an aid in determining the scope of the claimed subject matter.

Floor panel assemblies having vertical joining members are already known, for example from US 2009/0064624 A1.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An aspect of the present invention relates to a floor panel assembly comprising sheet-shaped floor panels, which floor panels are provided with a plurality of edges, a lower side and an upper side, whereby the floor panels are intended to be joined by means of joining members, each floor panel being provided on at least a first edge with a first joining member and, on a second edge, with a second joining member, the first and second joining members of two panels being configured to be joined by a movement of the two panels with their first and second edges towards to each other such that in the joined position the panels meet each other near their upper side along a seam, the first and second joining members locking the panels at the adjacent edges at least in a direction perpendicular to the upper side and in a direction parallel to the upper side but perpendicular to the adjacent first and second edges in their joined position, the first and second joining members being provided with at least one deformable locking element which is deformable, during said joining, from a first position allowing the first and second joining members to be joined, to a second position in which it locks the first and second joining members to each other at least in said direction parallel to the upper side.

According to an aspect of the invention, the deformable locking element is formed such that, in its second position, it locks the first and second joining members to each other in both said directions parallel and perpendicular to the upper side.

In one embodiment, the floor panel assembly is provided on one of the first and second joining members and comprises a first locking surface co-operating with a second locking surface on the other of said first and second joining members.

In a particular embodiment the second locking surface on the other of the first and second joining members is inclined and is facing away from the seam in the joined position of the panels. This enables a lock in both directions with one set of locking surfaces only.

In a further embodiment the locking element is provided with at least one and particularly two hinges, and in the joined position, one edge of the locking element being fixed to one of the first and second joining members and the other edge being provided with said first locking surface. The hinges allow a predetermined deformation of the locking element, while the formation of the locking surface at a free end of the locking element allows the locking element to wrap around one of said first and second joining members.

In an embodiment, the other end of the locking element comprises a hook bearing said first locking surface, whereas the other of the first and second joining members comprises a recess including said second locking surface.

In another embodiment, the first locking surface of the locking element extends substantially parallel to the direction in which the first and second joining members are joined to each other, when in its first position. This allows the other of said first and second joining members to easily pass the locking surface of the locking element before both locking surfaces engage.

In a further embodiment, the locking element comprises a control portion configured to co-operate with a control portion on the other of the first and second joining members in order to control movement of the locking element from the first to the second position. This allows for a precise control of the deformation of the locking element and required movement of the locking surface.

In a particular embodiment, the control portion of the locking element is at a distance from an underlying portion of the one of said first and second joining members in the first position, whereas a portion between the locking surface and the control portion is substantially adjacent to the underlying portion of the one of said first and second joining members. This configuration allows a deformation of the locking element in the direction of the underlying joining member which then causes at least a rotation of the locking surface.

Conveniently, the first and second joining members are configured as a male and female joining member, the locking element being attached to the female joining member. This allows the locking element to deform into the female joining member and to thereby wrap around the male joining member holding it in one or two directions.

In an embodiment, the female joining member comprises a depression which is at least locally covered by the locking element, the male joining member comprising a protrusion configured to co-operate with the locking element at a position above the depression of the female joining member. The protrusion of the male joining member could have a recess bearing the second locking surface on its side remote from the seam and at a distance from a crest of the protrusion.

In a further embodiment, the locking element is provided with at least one hinge which is positioned to co-operate with a crest of the protrusion of the male joining member. This allows the locking element to take the shape of the male joining member.

It is however also conceivable that the deformable locking element is attached to the male joining member, and has a control portion that is activated by an upward protrusion of the female member. The locking surface will then engage with a locking surface of the female joining member.

In a particular embodiment, the first locking surface on the locking element is at an angle of 90° or less relative to the adjacent surface on the locking element. This allows for a strong lock.

In a one embodiment, the locking element is constructed such that it requires force to move the locking element between the first and second positions and preferable through an intermediate position where a pretension in the locking element is reversed. This creates a distinct first and second position for the locking element and also enables the locking element to securely lock the other joining member to enable a proper connection between the panels.

Conveniently, the locking element is made of a separate plastic part, and any hinges are film hinges. It would also be conceivable to make the locking element from a metal.

In a particular embodiment, a plurality of locking elements is provided along the respective edge. This leads to narrower locking elements allowing easy connection of the adjacent panel edges, also when the edges do not make a perpendicular movement, for example if the panels are folded down.

Conveniently, the locking elements are interconnected to each other to form a locking strip. This enables easy preassembly of the locking elements to the panels.

In a particular embodiment, the locking strip includes a stop for the other of said first and second joining members and determines the position of the other of said first and second joining members in the second position of the locking element. This allows for an exact relative positioning of the panel edges.

In a further development thereof, the stop and the other of said first and second joining members comprise engagement surfaces to hold the other of said first and second joining members in the engaged position. This results in an even better vertical lock on the panel edges.

In a particular embodiment, the locking element and said one of said first and second joining members include means to maintain the locking element in its second position.

The means to maintain the locking element in its second position may include at least one of dimensioning the locking element such that it requires force to move the locking element between the first and second positions, and providing the locking element and said one of the first and second joining members with engagement surfaces engaging each other in the second position of the locking element.

In one embodiment, the first and second joining members are vertical joining members and the first and second joining members are joined to each other by a mainly vertical movement of the respective panel edges towards each other. In a development thereof, the locking element is locking the first male joining member in horizontal direction, and the first and second joining members being provided with third and fourth locking surfaces having at least a horizontal component to lock the joining members in a direction perpendicular to the upper side.

In a particular embodiment, the locking element is provided with a first locking surface directed substantially towards the seam and moving towards the seam when the locking element is moved from the first to the second position. This allows for an easy access of the other of said joining members, and also enables the elimination of gaps between the panel edges.

In a further embodiment, the male vertical joining member is provided with a tongue having on its upper surface the third locking surface and the female vertical joining member having an undercut bearing the fourth locking surface.

In a simple embodiment, the third and fourth locking surfaces are substantially adjacent to the surfaces forming the seam between the panels.

In one embodiment, the locking element has a first end and an opposite second end, the first locking surface being provided near the second end which is a free end, the locking element being fixed to the female joining member at the first end.

In a particular embodiment, each panel is substantially rectangular and has opposite third and fourth edges adjacent to the opposite first and second edges. Then, the third and fourth edges of each panel may be equipped with joining members which allow a joining of the third and fourth edges of two panels by bringing the third and fourth edges into engagement with each other in a relatively inclined position of the panels and then rotating said panels with respect to each other so as to bring the upper sides of both panels substantially in alignment with each other, thereby also bringing the vertical joining members of the first and second edges of the tilted panel and an adjacent panel into engagement. Such embodiment of the floor panels enables an easy assembly method, known as the fold down method.

In another embodiment, the first and second edges of the panels are joined to each other through a movement of the edges substantially parallel to the upper sides of the panels, the locking element being configured to be activated by a movement of the edges parallel to the upper side.

In this embodiment, the locking element may be configured to prevent a movement of the panels in one direction perpendicular to the upper sides of the panels, whereas a ridge between the first and second edge of the panels prevents a movement of the panels in the opposite direction.

In another aspect of the invention, the locking element is provided with at least two hinges and in the joined position, a first end of the locking element is fixed to one of said first and second joining members and the second end is in engagement with the other one of said first and second joining members. Conveniently, the first and second joining members are configured as a male and female vertical joining member, the locking element being attached to the female vertical joining member. Then, the female vertical joining member comprises a lip protruding substantially parallel to and from the lower side of the panel at the first edge, said lip having a depression which is at least locally covered by the locking element, said depression having an upright wall near the free end of the lip and the locking element being adjacent to this upright wall when the locking element is in its second position. This leads to a strong connection between the panels, especially in horizontal direction.

Herein, the second end may be configured as a hook provided with a locking surface configured to co-operate with a locking surface on the other one of said first and second vertical joining member. The hook may be at an acute angle to an adjacent portion of the locking element which is provided with one of the hinges.

It is then possible that one of the hinges is positioned substantially above a bottom of the depression in the female vertical joining member. It is favorable if, when the first and second edges are locked to each other, the locking element urges the panels towards each other to close the seam therebetween.

In another aspect of the invention, said locking element having a first and opposite second end, a fixing portion at the first end, a control portion at a position between the ends and a locking portion at the second end.

Conveniently, the control portion of the locking element is at a distance from an underlying portion of the joining member in the first position, whereas a portion of the locking element between the locking portion and the control portion is substantially adjacent to the underlying portion of the joining member. In the second position of the locking element the control portion is preferably adjacent to the underlying portion of the underlying joining member.

In a further aspect of the invention, the movement of the locking element from the first position to the second position is substantially in one direction only, starting from a substantially horizontal position of the main portion of the locking element. The other of said first and second vertical joining members may be provided with a control portion to at least start the deformation of the locking element, said control portion being positioned such that during joining of said first and second edges the control portion comes into contact with the locking element at a position between its ends, thereby loading the locking element substantially perpendicularly to its main portion.

In another aspect of the invention, the locking element locks the first and second joining members to each other in both said directions parallel and perpendicular to the upper side when it is in the second position.

An aspect of the invention also includes a floor panel for use in the floor panel assembly as described above, a locking element for use in this, and a strip comprising a plurality of such locking elements.

BRIEF DESCRIPTION OF THE DRAWINGS

Further details and advantages of aspects of the invention will follow from the below description with reference to the drawings showing an embodiment of the panel assembly by way of example.

DETAILED DESCRIPTION OF THE ILLUSTRATIVE EMBODIMENTS

Figure 1:
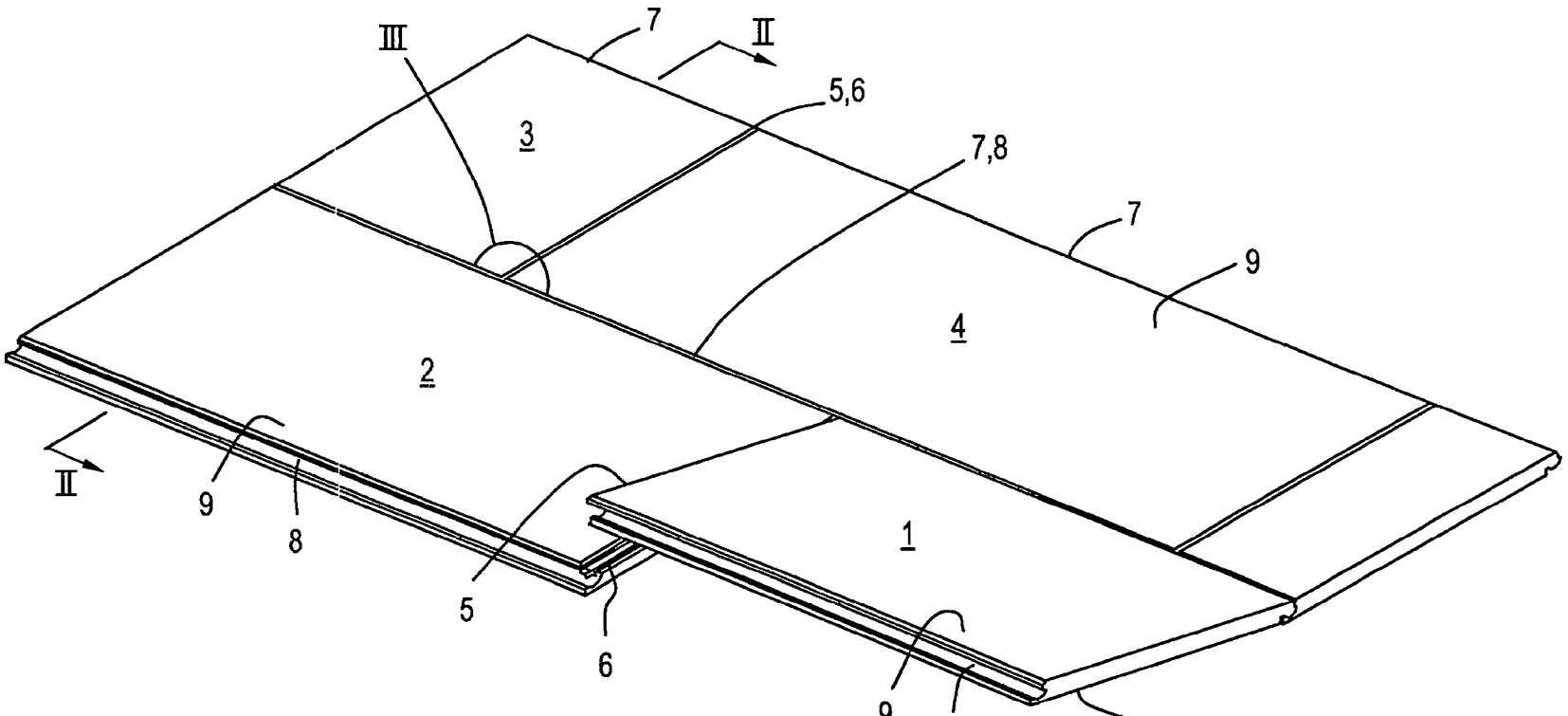
FIG. 1 is a perspective view of a plurality of panels of a panel assembly in a stage of laying the panels.
Figure 2:
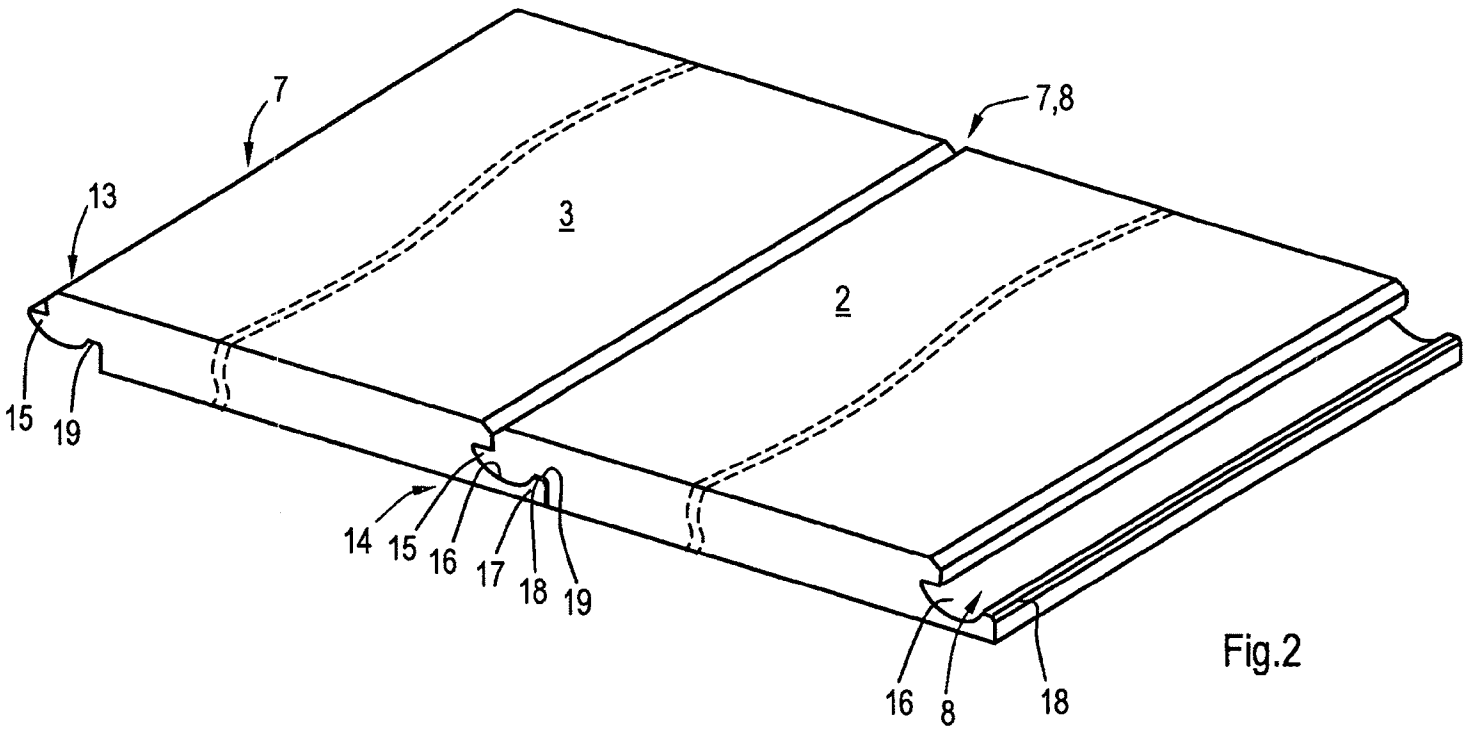
FIG. 2 is an enlarged cross sectional view according to the line II-II in FIG. 1 showing partly two panels with their third and fourth edges on the long sides of the panels.

The drawings and in first instance FIGS. 1 and 2 thereof, show a number of panels of an embodiment of a panel assembly having aspects according to the invention. In particular, FIG. 1 shows a first panel 1, a second panel 2, a third panel 3 and a fourth panel 4. These panels are substantially rectangular and may both be square or elongated. The four panels shown are elongated having a first edge 5 and an opposite second edge 6 that are the short edges, and a third edge 7 and an opposite fourth edge 8 that form the long edges.

In principle the panel assembly is intended to form a floor covering, but the panels may also be used as wall panels, ceiling panels or panels for covering other surfaces. These surfaces may be indoor or outdoor surfaces.

In a particular embodiment, the panels may be constructed as laminate panels for forming a laminate flooring which is well known in the art. These panels are used to imitate planks or tiles of natural material, such as wood, stone or any other material. Generally these laminate panels comprise a core of relatively cheap material, in particular a wood based material such as material including wood particles or fibers such as MDF/HDF, a wood plastic composite (WPC) or other composites including plastics. The core of these panels is covered by a decorative layer formed for example from transfer foil or a laminate of paper layers immersed with resin. The decoration may also be formed in a different way, for example by printing directly and/or digitally on the core, or by finishing the core by embossing, chafing or the like. An upper surface 9 is formed thereby. A lower surface 10 of the panels may be formed by another layer, for example a water-proof coating or sheet. However, aspects of the invention are also applicable for panels made of wood, plastic or other material with or without separate upper and/or lower layers.

The edges 5-8 of each panel 1-4 are provided with joining members to join the panels to each other to obtain a floor covering in which the panels are coupled to each other substantially without the formation of a gap. For this purpose, the first edge 5 of each panel is provided with a first or male vertical joining member 11, the second edge 6 with a second or female vertical joining member 12, whereas the third edge 7 is provided with a first or male horizontal joining member 13 and the fourth edge 8 with a second or female horizontal joining member 14.

The third and fourth edges 7, 8 with the first and second joining members 13, 14 are shown in FIG. 2 and may be configured in a well known manner. These joining members 13, 14 are such that they allow a joining of the third and fourth edges 7, 8 of two panels by bringing the male joining member 13 in contact with the female joining member 14 of a panel or of two panels which are already installed on the surface. In FIG. 1, panel 1 is brought in engagement with panels 3 and 4. The first male joining member 13 is brought in engagement with the second female joining member 14 while the panel 1 is held in a relatively inclined position, where after panel 1 with the male joining member 13 is rotated with respect to the other panels 3 and 4 so as to bring the upper surfaces 9 of the panels substantially in alignment with each other. This method is also known as the "angling in" joining method. In principle, it would also be possible to angle in a female joining member onto a male joining member of a panel already installed.

In the embodiment shown in FIG. 2 the joining members comprise locking means which prevent the panels from drifting apart in a direction parallel to their surfaces 9, 10 and perpendicularly to their edges 7, 8. These locking means are configured such that they exert a force urging the panels towards each other (i.e. perpendicular to their edges) while the panels are in their joined condition. This force counteracts the formation of gaps between the panels, in particular at the position near the upper surface 9 where the panels meet each other. This position may be exactly at the upper surface in the situation of FIG. 4, but in case the upper edges of the panels are machined for example to form a V-groove (see FIG. 1-3), U-groove or other lowered area between the panels, the panel edges will meet at a distance from the upper surface 9.

FIG. 2 also shows that the first male joining member 13 includes a tongue 15, while the second female joining member 14 includes a groove 16 which is able to receive at least a portion of the tongue 15 therein so as to lock the panels with respect to each other in a direction perpendicularly to surfaces 9, 10, i.e. in vertical direction. The shape of the tongue and groove 14, 15 may have all kinds of configurations and orientations as long as they include surfaces that restrict movements in a direction perpendicularly to the surfaces 9, 10.

The horizontal lock of the panels away from each other is accomplished by means of a lip 17 below the groove 16 projecting from the panel 2 and carrying near its free edge an upper protrusion 18 engaging into a lower groove 19 positioned behind the tongue 15 of the panel 3.

Figure 3:
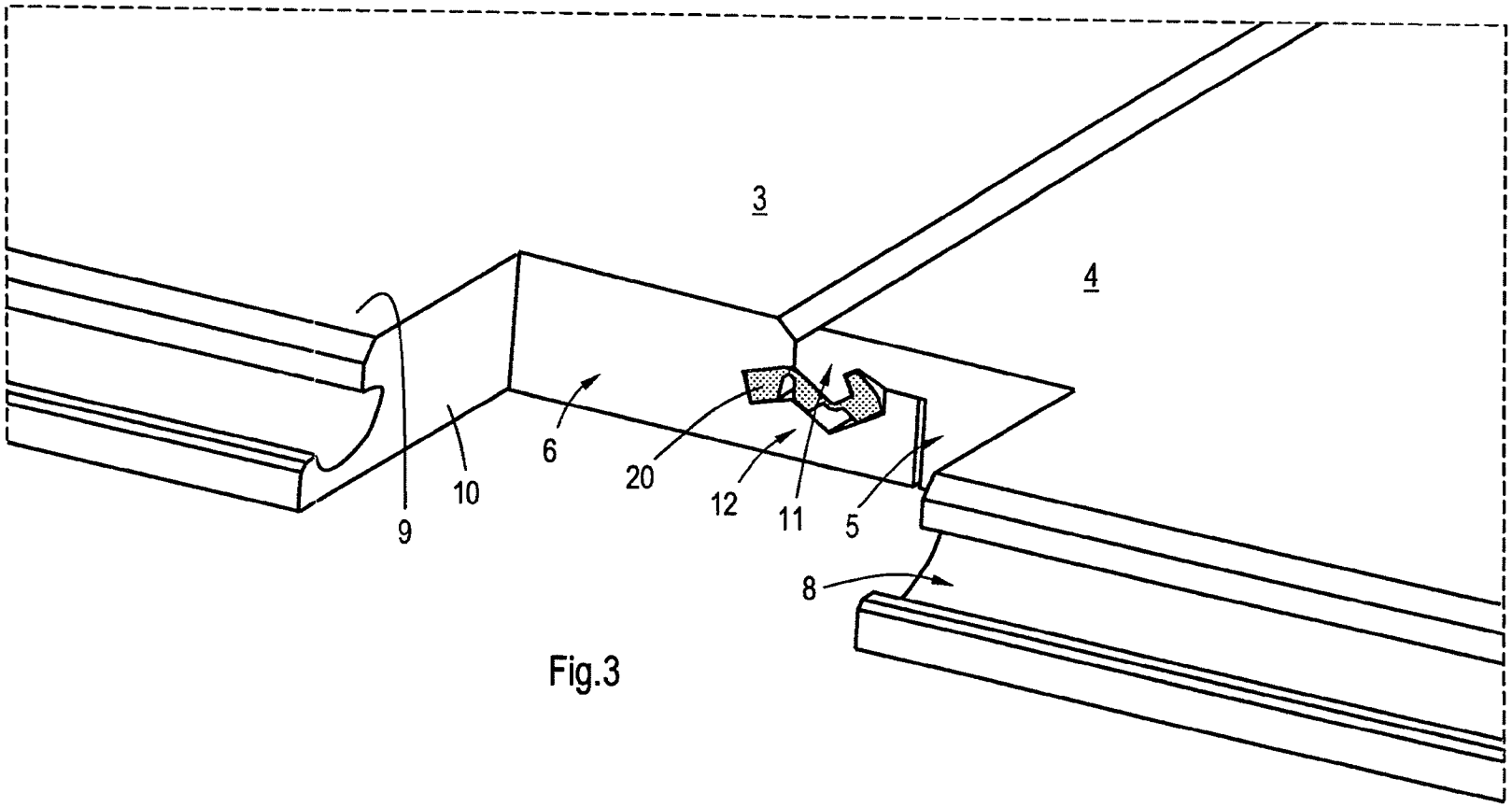
FIG. 3 is a perspective view of partly cut-away detail III-III in FIG. 1 showing the joined first and second edges on the short side of two panels of FIG. 1.

FIGS. 3 and 4 show first and second edges 5, 6 of the panels 1, 2 with the first and second joining members 11, 12 enabling the edges to be coupled to each other.

It is shown in the drawings that the second joining member 12 of the second panel 2 is provided with a separate locking element 20 which is fixed to the second joining member 12, but which has sufficient freedom of movement to move or deform in order to cooperate with the first joining member 11 in order to couple the joining members 11, 12 to each other such that it locks the first and second joining members 11, 12 to each other in both a direction perpendicular to the upper surface 9 and in a direction parallel to the upper surface 9 but perpendicular to the adjacent first and second edges 5, 6 in their joined position. For this purpose, the locking element 20 is deformable from a first position, allowing first and second joining members 11, 12 to be joined, to a second position in which it locks the first and second joining members 11, 12 to each other.

In the embodiment shown, the locking element 20 is provided with a fixing portion 21 on one of its ends, a locking portion 22 on its other, free, end and with a control portion 23 in between. The locking element 20 may extend along the whole length of the first edge 5, but preferably there are provided a plurality of short locking elements 20 distributed along the length of the edge 5, or even only one short locking element 20 substantially in the middle of the second edge 6. The length and placement of the locking element 20 depends on various factors, in particular the length of the edges 5, 6, the material of the panels and the particular use of the panel assembly. The use of one or more narrow locking elements facilitate a connection between two panel edges when the edges are moved towards each other in a non-parallel orientation, for example, if one panel is folded down. Also the locking effect is better when there is a high local load because if one locking element is disengaged due to the high local load, the other locking elements will remain locked and keep the edges together.

The fixing portion 21 of the locking element 20 is fixed, in particular before delivery, for example glued or clamped into a groove 24 which may extend along the whole edge 6 of the panel and may be inclined at an angle, in this case of about 20° with respect to the lower surface 10 of the panel. The groove 24 ends on the upper side at a vertical wall surface 25 adjacent to the upper surface 9 of the panel which in the joined position of the edges 5, 6 is in contact with a vertical wall surface 26 of the first edge 5. In the joined position, these wall surfaces 25, 26 (which may also be non-vertical) form a seam near the upper surface 9 of the panel.

The panel portion below the fixing groove 24 is extended into a protruding lip 27 including in its upper surface a depression 28 adjacent to groove 24. In the embodiment shown, the depression 28 has a V-shaped configuration with the bottom parallel to the edge 6. On its free end the lip 27 is provided with an upper projection 29 having an upright wall surface 30 bordering the depression 28. On the free end of the lip 27 remains a free space 31 to the first edge 5 of the other panel in order to ensure that the seam between the vertical wall surfaces 25, 26 near the upper surface 9 of the panels can be closed.

The first or male vertical joining member 11 comprises a downward protrusion 32 having a substantially V-shaped lower surface, the lower crest of which extends parallel to the first edge 5 and is vertically aligned with the lowest point of the V-shaped depression 28 when the first and second joining members 11 and 12 are in their coupled condition. The crest of the protrusion forms the lowest point of the first joining member 11 where the distance from the upper surface 9 of the panel is at a maximum. On the lower side of the first edge 5 is a recess 33 which is sufficiently large to take up the lip 27 of the female joining member 12 in the coupled condition of the joining members 11, 12. The edge 5 of a panel may or may not rest on the upper side of projection 29 at the edge 6 of the adjacent panel.

The protrusion 32 has on its side facing away from the vertical wall surface 26 and at a distance from the crest of the protrusion a recess 34 having a locking surface 35 configured to cooperate with a locking surface 36 on the locking portion 22 of the locking element 20. The locking surface 35 is inclined with respect to the upper surface 9 and the vertical wall surface 26. The angle may vary with respect to the upper surface 9 of the panel.

As is clearly shown in FIGS. 3 and 4, the locking element 20 comprises two hinges 37 and 38 parallel to the second edge 6 of the respective panel and enabling the locking element 20 to deform. The hinge 37 is positioned between the fixing portion 21 and the control portion 23 of the locking element 20, while the hinge 38 is positioned between the locking portion 22 and the control portion 23. As noted above, the locking portion 22 is provided with the locking surface 36, which is at an acute or, in the present case at a right angle to an adjacent surface of the locking portion, and which is oriented substantially vertically in the first position of the locking element 20.

The hinges 37 and 38 are film hinges formed in one piece with the locking element 20 and having a substantially diminished thickness with respect to the adjacent portions of the locking element 20, thereby allowing an elastic/plastic deformation of the locking element at the position of the hinges 37, 38.

The operation of the joining members 11, 12 is as follows.

When panel 1 is in the position according to FIG. 1, edge 5 and therefore joining member 11 of first panel 1 comes gradually in engagement with edge 6 and joining member 12 of panel 2. In one cross section, the panels 1, 2 may be in the relative position according to FIG. 4*a*. The locking element 20 is in its first position with the upper side of the control portion 23 and an adjacent surface of the locking portion 22 substantially horizontal. The lower side of the control portion 23 and a part of the locking portion adjacent to the hinge 38 is at a distance from the underlying portion of the second joining member 12, i.e. the depression 28 in the lip 27. This enables a deformation of the locking element 20 and downward rotation of the control portion 23 of the locking element 20. The locking portion 22 is at a position distant from the hinge 38 in engagement with the underlying second joining member 12, i.e. the depression 28 adjacent to the upright wall surface 30. This engagement prevents a complete downward movement of the locking portion 22 as a result of the downward rotation of the control portion 23, but allows a rotation of the locking portion 22 with the hinge 38 moving downward.

Figure 4A:
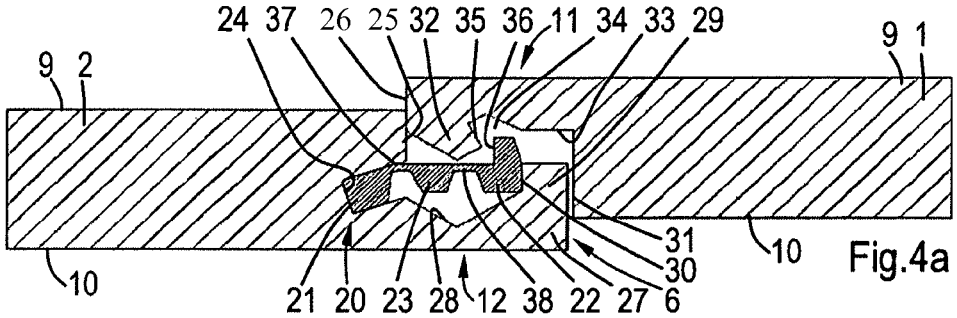
FIG. 4*a-d* are cross sectional views of the subject of FIG. 3, in four different positions illustrating the joining of the joining members on the first and second edges of the panels.
Figure 4B:
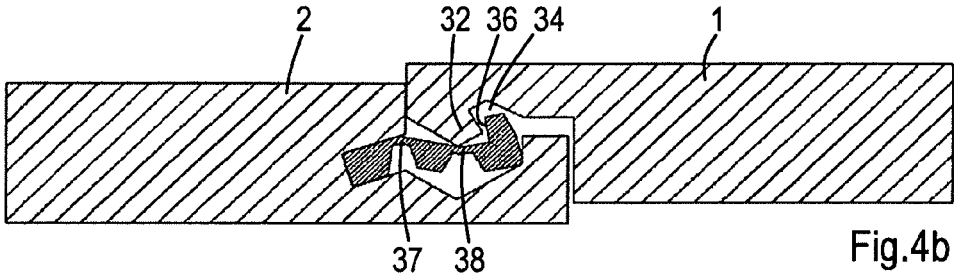
Figure 4C:
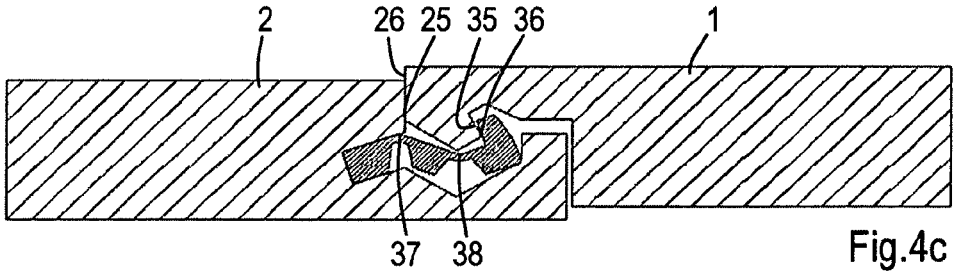
Figure 4D:
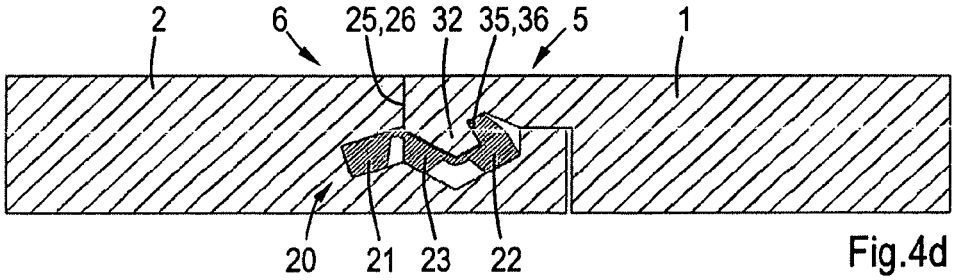

The downward deformation of the locking element 20 is caused by the downward movement of the first joining member 11 and the engagement of the crest of the protrusion 32, acting as a control portion of the first joining member 11, with the control portion 23 of the locking element 20 of the second joining member 12 at a position near the hinge 38. The movement of the protrusion, as seen in the cross section according to FIGS. 4*b* and 4*c*, is substantially perpendicular to the main portion of the locking element 20, which extends substantially horizontal in the first position, so that the locking element is easily deformed by the protrusion 32. The control portion 23 rotates downwardly around the hinge 37, and the locking portion 22 rotates upwardly around the hinge 38. This rotation of the locking portion also causes a rotation of the locking surface, and during the downward movement of the protrusion 32 of the first joining member 11, the free end of the locking element 20 with the locking surface 36 rotates into the recess 34 in the protrusion 32, such that finally in the second position of the locking element 20 according to FIG. 4*d*, the locking surfaces 35 and 36 abut. As is clear, there is a movement substantially in one direction only when the locking element 20 moves from the first to the second position.

In the second position of the locking element 20, the locking surface 36 thereof locks the first joining member 11 of the first panel both in horizontal and vertical direction. The crest of the protrusion is positioned substantially at the hinge 38 and vertically in line with the bottom of the depression 28, so that the locking elements takes up the same V-shape as that of the depression and the lower side of the protrusion 32. In the second position of the locking element 20, the lower and upper sides thereof are in contact with the surface of the depression 28 and protrusion 32, respectively, and are held in contact due to the lock of the locking element 20.

This lock will be stronger if more force is needed to disengage the locking surfaces 35 and 36 again. This can be obtained for example if the friction between the locking surfaces 35 and 36 is large or if the locking element 20 is snapped into the recess 34. A proper dimensioning of the joining members 11, 12 may realise this, for example curving the surfaces or by dimensioning the parts such that the joining element 20 must be stretched in order to allow engagement of the locking element into the recess 34. Also if a return movement of the hinges 37, 38 is hindered or requires a force, the unlocking of the joining members 11, 12 will be disabled or hindered. If a return upward movement of the first joining member 11 is prevented, the disassembly of the panels 1 and 2 may be accomplished by sliding one panel with respect to the other along the edges 5, 6.

Figure 5:
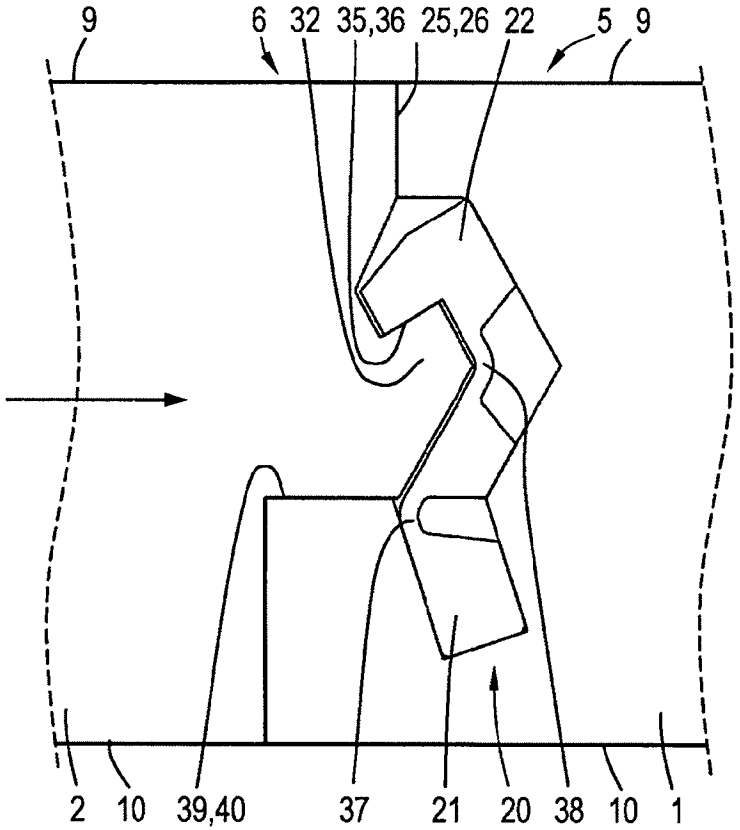
FIG. 5 is a view corresponding to that of FIG. 4*d*, but showing a second embodiment of the joining members of the floor panel assembly.

FIG. 5 shows a variation, in which the locking element 20 is used to lock two panels 1 and 2 to each other when the first and second edges are moved towards each other in a direction substantially parallel to the upper sides 9 and 10 of the panels 1 and 2 and substantially perpendicular to the edges 5 and 6. The locking element 20 and the parts cooperating with it are similar to that in FIGS. 1-4, only the orientation of these parts have been rotated 90° so that the locking element 20 opens up in horizontal direction and can receive the male joining member 11 when it is moved towards the female locking member 12 and locking element 20 in horizontal direction. The locking surfaces 35, 36 of the locking element 20 and of the male joining member 11 prevent a movement of the second edge 6 in upward direction and in a direction away from the first edge 5. Horizontal surfaces 39, 40 of the first and second edges which abut when the first and second edges 5, 6 engage prevent an upward movement of the first edge 5. This locking action could also be provided by a second locking element turned upside down. Other variations are conceivable.

FIGS. 6-10 show a third embodiment similar to that of FIGS. 1-4, but in which the first and second locking surfaces 35, 36 of the locking element 20 and of the male joining member 11 lock the first and second edge 5, 6 of the panels 1 and 2 in cooperation with third and fourth locking surfaces 41, 42 on the male and female joining members 11, 12.

Figure 9A:
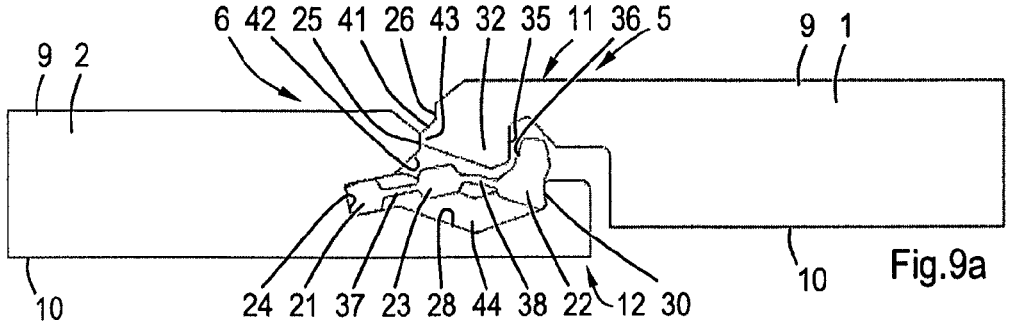
FIGS. 9*a*, 9*b* are views according to the arrow IXa FIG. 7*a*, in two different positions.
Figure 9B:
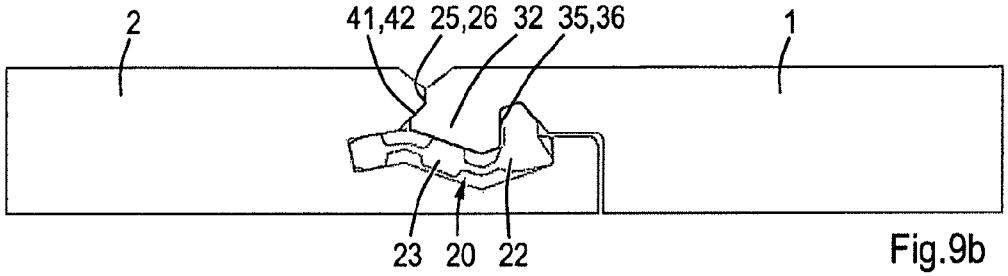

FIGS. 9*a* and 9*b* most clearly show the resemblance of the locking element 20. In this embodiment, and this may also be the case in the first and second embodiment, the locking element 20 is fit between the groove 24 and the wall 30 such that the locking element is stable in the first and second positions as shown, but must be pushed with force through an, unstable, intermediate position where the direction of a pretension is reversed. This is caused by the fact that the length of the locking element 20 is larger than the distance between the groove 24 and the wall 30. The hinges 37 and 38 enable a deformation of the locking element 20 through the intermediate position. Due to this construction, the locking element 20 will be forcibly held in the second position and is able to effectively lock the male joining member 11. The locking element 20 is formed at the position where the upright wall 30 and the depression 28 meet as a pivot to guide the pivoting movement of the locking portion 22 of the locking element. Other click or snap constructions are possible of course.

In this third embodiment it is shown that the locking surface 35 of the male joining member 11 is substantially vertical, so that when it is in engagement with the locking surface 36 of the locking element 20, it will only be held in horizontal direction, i.e. in a direction parallel to the upper sides 9, 10 of the panels 1, 2. The lock in a direction perpendicular to the upper sides is in this case effected by the third and fourth locking surfaces 41, 42 mentioned above. The third locking surface is formed on the upper side of a tongue 43 which protrudes from the vertical surface 26 and adjacent to the downward protrusion 32 on the first edge 5. The angle of the third locking surface 41 to the upper side is approximately 45°, but may vary as long as there is a horizontal component to prevent an upward movement of the edge 5 when the locking element 20 is in the second locking position.

The fourth locking surface 42 is formed at an undercut adjacent to the vertical surface 25 on one side and to the fixing groove 24 on the other side. The angle of the fourth locking surface 42 is substantially equal to that of the third locking surface, but this is not required. The third and fourth locking surfaces 41, 42 may also be positioned in other places.

From FIGS. 9*a*, 9*b* it becomes clear that in the first position of the locking element 20 according to FIG. 9*a*, the locking portion 22 is pivoted away from the vertical wall surface 25, so that a large opening for the protrusion 32 of the male joining member 11 is formed and it is thus easy to enter the protrusion 32 in a substantially vertical direction. The protrusion 32 will meet the control portion 23 of the locking element 20 substantially at the same time as the third and fourth locking surfaces 41, 42 come into contact. When the control portion 23 of the locking element is pushed down, the locking portion 22 will pivot and therefore the locking surface 35 will move in the direction towards the vertical surface 25 and will thus horizontally push against the locking surface 36 and thereby move the whole panel 1 horizontally so that the third and fourth locking surfaces 41, 42 fully come into engagement until the vertical surfaces 25, 26 meet and the male joining member is fully pushed down. The locking element 20 is pushed through the intermediate position and is now pretensioned to keep the locking surfaces 35, 36 and therefore also the vertical surfaces 25, 26 forming the seam between the panels 1 and 2 in abutment preventing the formation of a gap there.

Figure 10A:
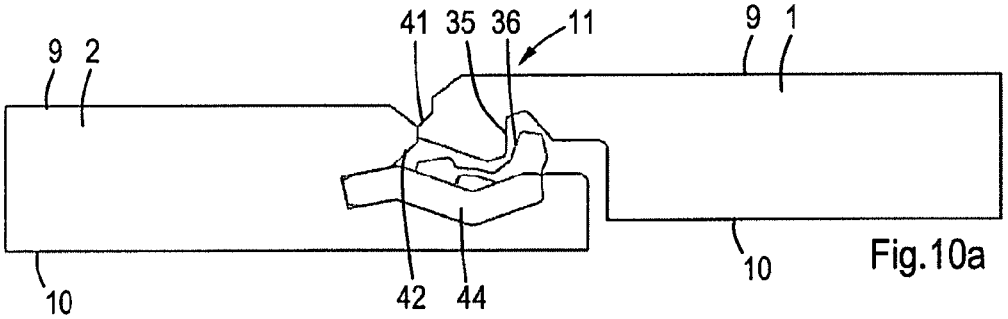
FIGS. 10*a*, 10*b* are views according to the arrow Xb in FIG. 7*b* in two different positions.
Figure 10B:
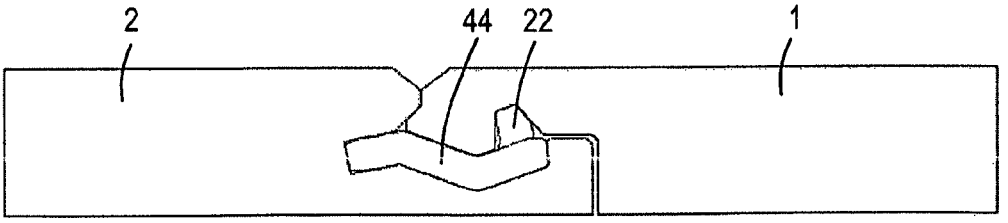

As becomes clear from FIGS. 10*a* and 10*b*, the locking element 20 is provided with a stop 44 determining the end position of the protrusion of the male joining member 11. It is placed on a side of the locking element 20 which extends only along a part of the length of the edge 5.

Figure 6:
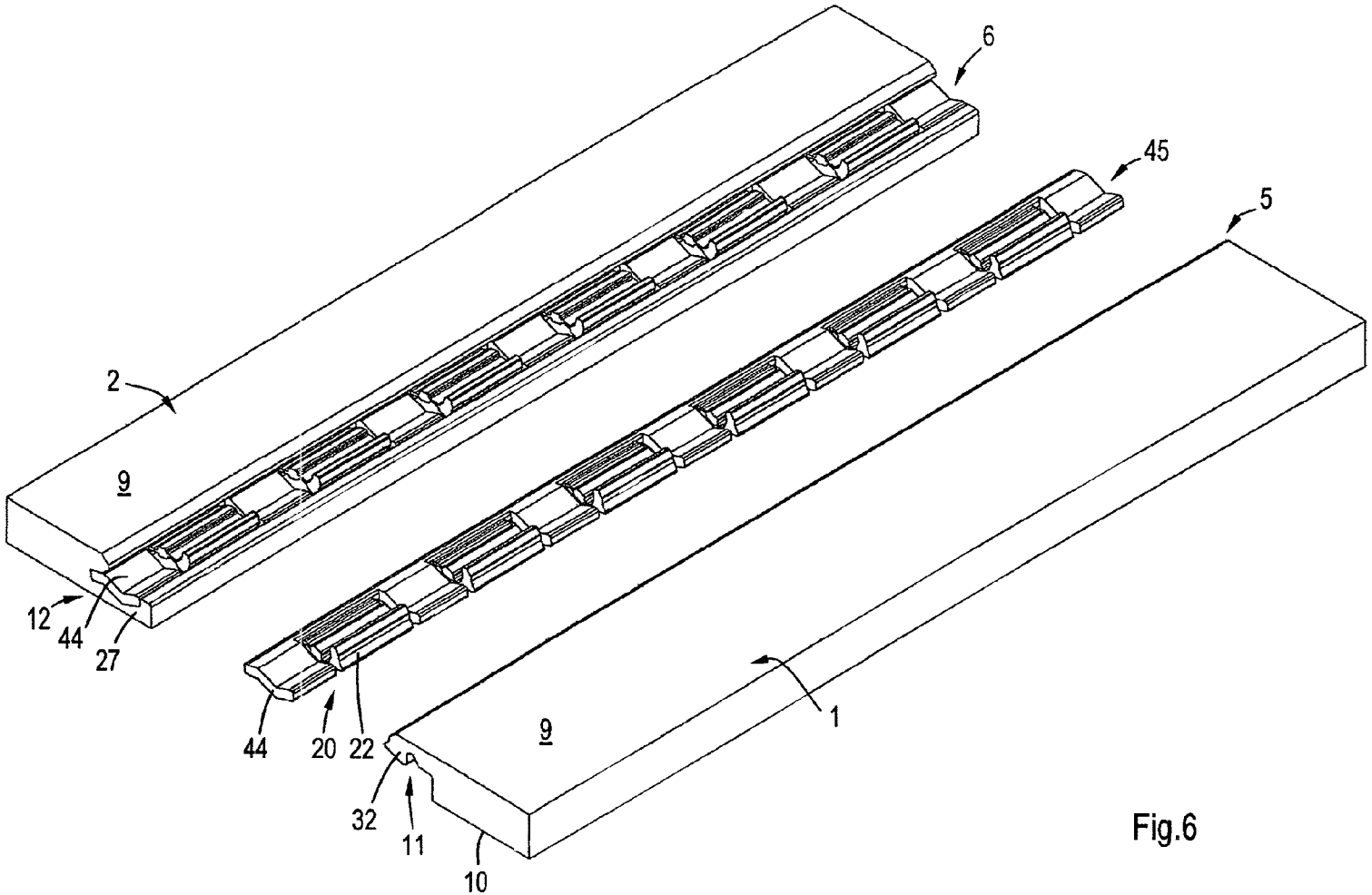
FIG. 6 is a perspective view of the first and second edges of two panels having joining members according to a third embodiment.
Figure 7A:
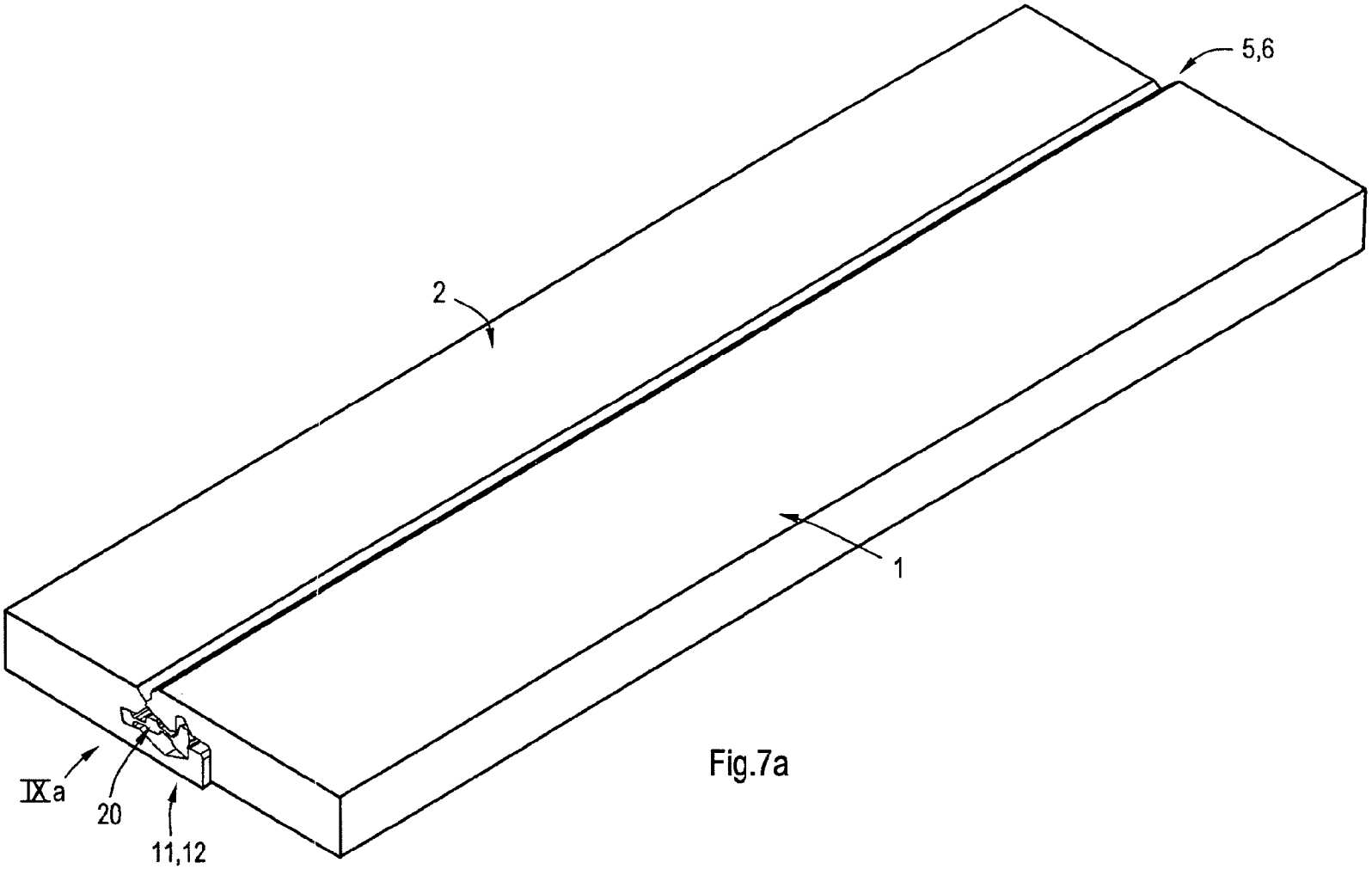
FIGS. 7*a*, 7*b* are views corresponding to that of FIG. 6, but showing the joining members in a non-joined and joined position.
Figure 7B:
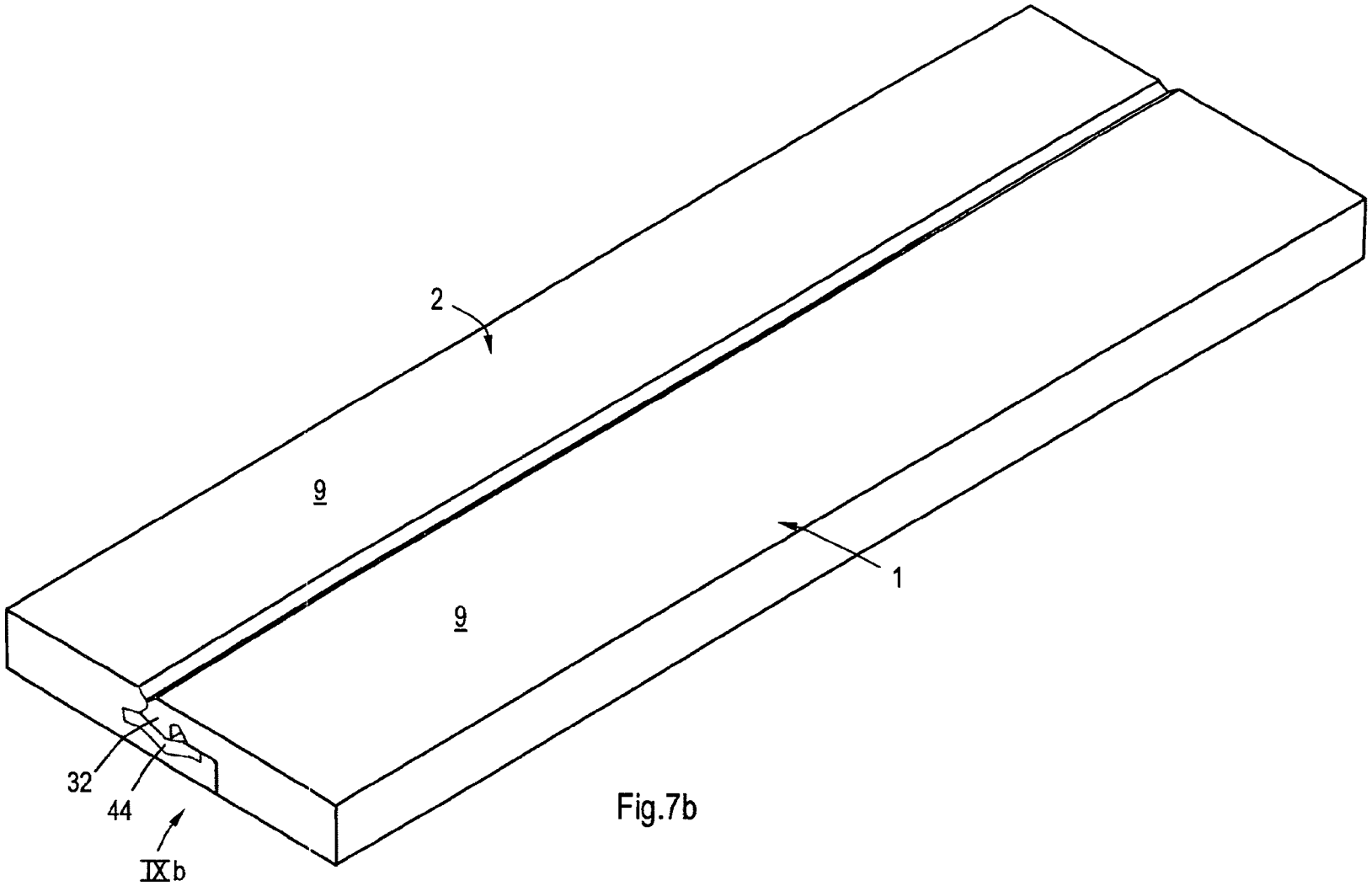
Figures 8A, 8B:
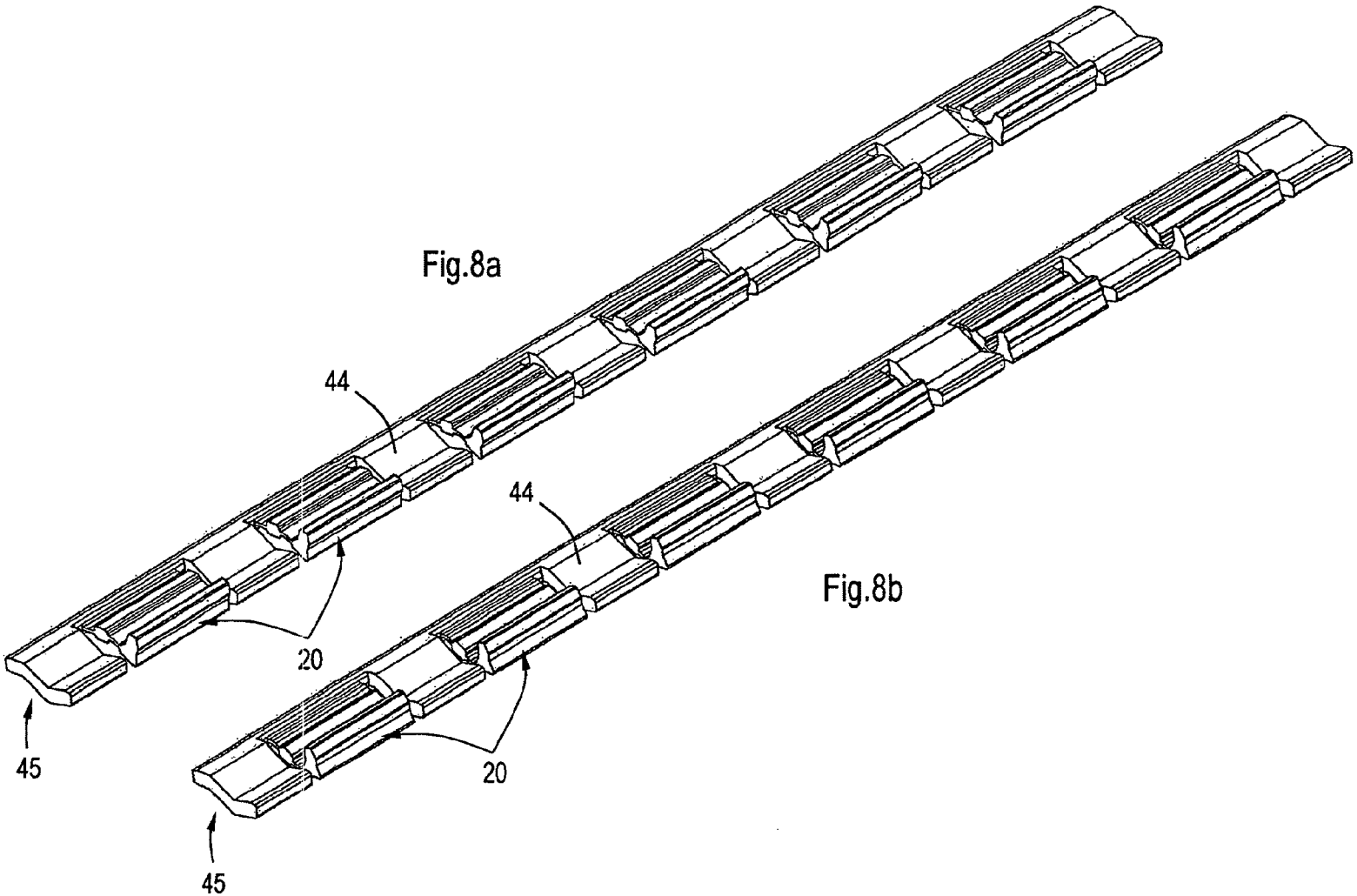
FIGS. 8*a*, 8*b* are perspective views of a locking strip showing the locking elements in their non-joined and joined position according to FIGS. 7*a*, 7*b*.

FIGS. 6-8 show that a great number of locking elements 20 and stops 44 are combined into a strip 45 which may extend substantially the full length of the edge 5. A connecting beam 46 forms at least a part of the fixing portions 21 of the locking elements 20 and extends continuously along the strip 45 thereby connecting the locking elements 20 and the stops 44 which are arranged alternatingly. The stops 44 follow the groove 24 and the bottom of the depression 28 and are (press) fit between the bottom of the groove 24 and the upright wall 30. To compensate for tolerances, the strip 45 may be slightly compressible at the bottom of the groove 24, for example by means of a notch or cut from above to form a finger at the end of the stop 44.

Figure 11:
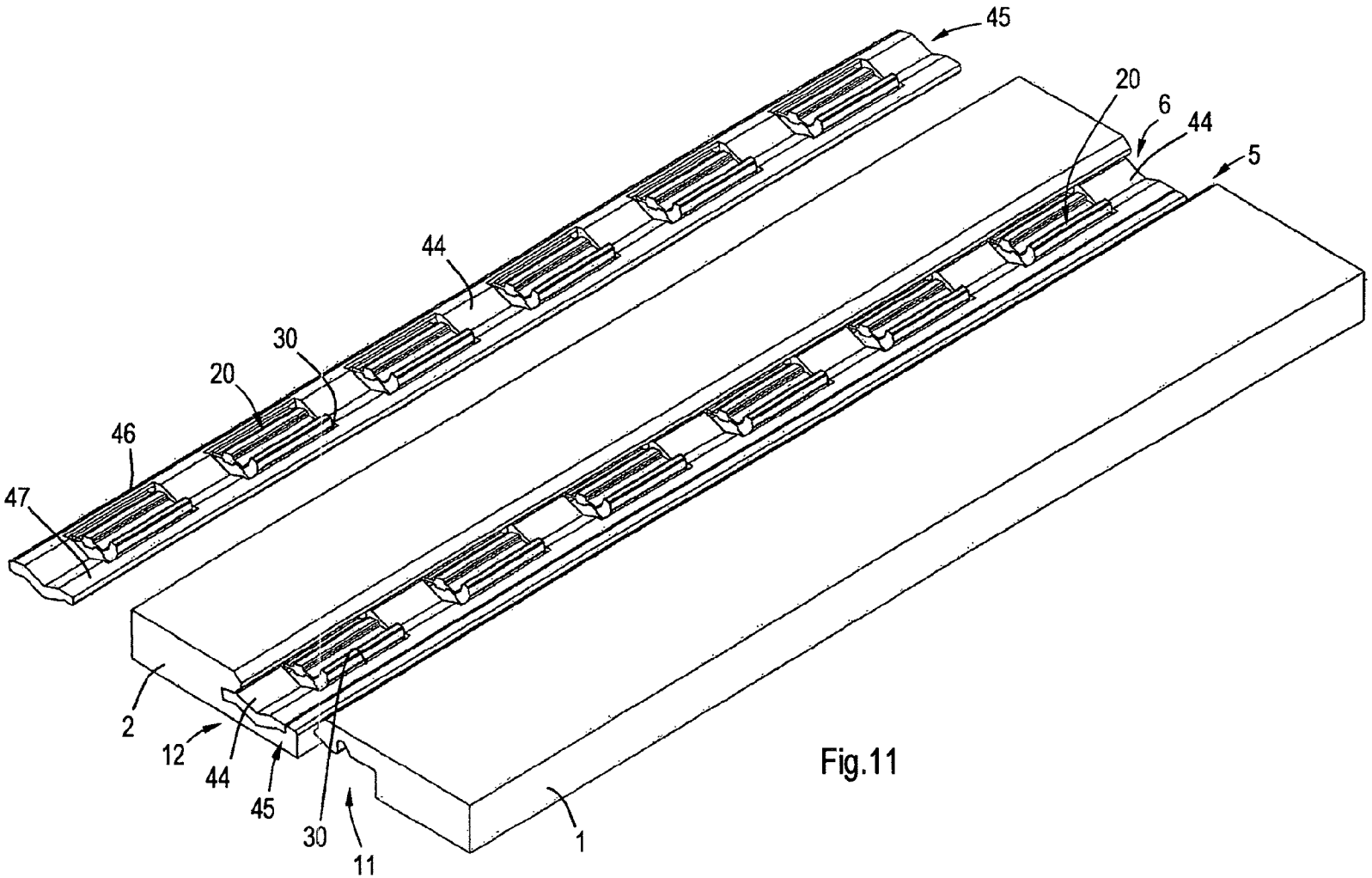
FIG. 11 is a perspective view of the first and second edges of two panels having joining members according to a further embodiment, as well a separate strip as used therein.

FIG. 11 shows a variation of the third embodiment in which the stops 44 are also connected to each other on the edge opposite to the beam 46 by means of a beam 47 making the strip more stable against warping and other deformations. The function of the upright wall 30 is now taken over or complimented by this beam 47.

Figure 12A:
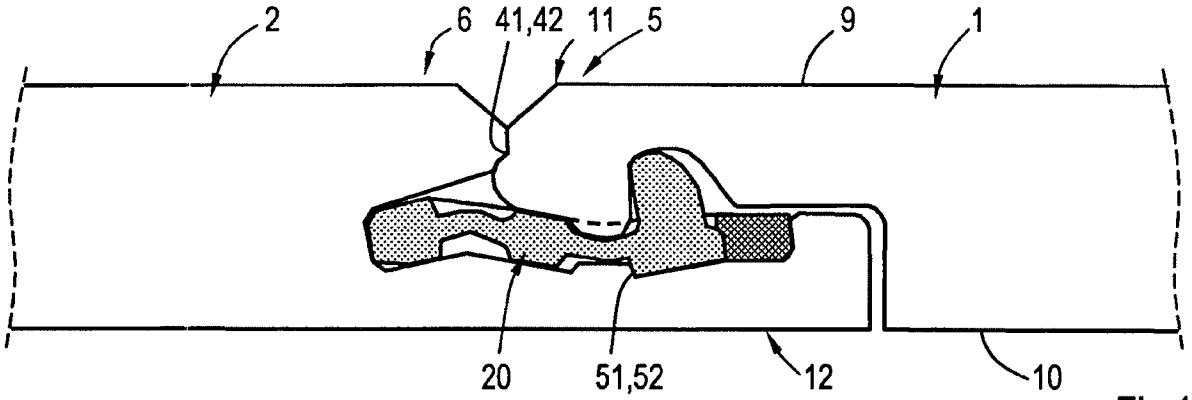
FIGS. 12*a*, 12*b* are cross sectional views corresponding to that of FIGS. 9*b* and 10*b*, but showing a variation of this embodiment of the panel assembly.
Figure 12B:
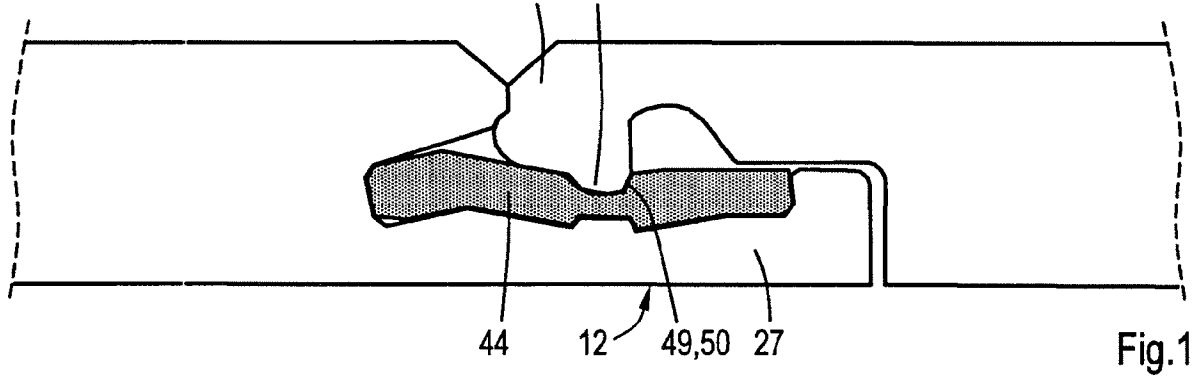

FIGS. 12*a* and 12*b* show another variation of the embodiment of FIGS. 6-10. In this variation, there are provided additional means to maintain the locking element 20 and the male joining member 11 in their second position. For this purpose, the protrusion 32 of the male joining member 11 is provided with a nose portion 48 having an engagement surface 49 configured to come into engagement surface 50 on the stop 44. The engagement surfaces can be made mainly parallel to the locking surfaces 41 and 42, respectively, and assist in keeping the male and female joining members 11, 12 in engagement with each other, both in horizontal and vertical direction. The nose portion 48 extends along the whole length of the male joining member 11, and the locking elements 11 are shaped to allow the engagement surfaces 49 and 50 to come into engagement without blocking the downward movement of the male joining member 11.

Furthermore the locking element 20 and the lip 27 of the female joining member 12 are provided with engagement surfaces 51 and 52 which act more or less as snap members such that the engagement surface 51 of the locking member 20 hooks behind the engagement surface 52 of the lip 27. These engagement surfaces are particularly useful in case the dimensions are such that it is not possible to push the locking element sufficiently downwards through the intermediate position as described above in relation to FIGS. 6-10. This may for example be the case with thin panels, for example below 7 mm. In general, the lock will be light so that the surfaces 51 and 52 can be easily disengaged when a panel should be removed.

In FIG. 12 it is also visible that the locking elements 20 and the remainder of the strip 45 are formed separately. First the locking elements 20 are formed, preferably by injection molding, and then the locking elements are placed in a second mold in which the remainder of the strip 45 is formed during which the plastic of the strip 45 is molded around the end of the locking elements 20 near the fixing portion 21 so that an integral strip 45 is formed. Generally the complete strip 45 is made from the same material, for example polypropylene to obtain good deformation properties, but it is also possible to form the locking elements 20 from different material than the remainder of the strip 45. The connection between the locking elements 20 and the remainder of the strip 45 is mechanical, i.e. by a shape lock, but a chemical bond is conceivable as well.

It is noted that aspects of the various embodiments as shown and described may be used in different combinations. The invention is not limited to the embodiments shown in the drawing and described above, which may be varied in different ways within the scope of the invention. For example, it would be possible to use the invention with panels that have vertical joining members on all four sides and that can thus be laid by moving the panels vertically with respect to one, two or more panels already installed. Furthermore, it would be conceivable that the locking element has separate surfaces to lock the vertical joining members in two different directions. Although the locking element has been described before as an element that is separate from the panels, it could be integrated in one of the panels, especially if the panels are made from plastic material. It is also possible that each of the first and second joining members has its own locking element co-operating with the other one. Both locking elements could be deformable or only one. It is also conceivable that the single locking element only locks the panels in cooperation with other locking means, such as ridges, tongues and grooves, hooks and undercuts and the like. The panels may have a different configuration than substantially rectangular, in particular triangular or hexagonal. The panel edges should be configured such that adjacent panel edges have matching joining members.

What is claimed is:

1. A floor panel assembly comprising sheet-shaped floor panels, which floor panels are provided with a plurality of edges, a lower side and an upper side, whereby the floor panels are configured to be joined by joining members, each floor panel being provided on at least a first edge with a first joining member and, on a second edge, with a second joining member, the first and second joining members of two panels being configured to be joined by a movement of the two panels with their first and second edges towards to each other such that in a joined position the panels meet each other near their upper side along a seam, the first and second joining members locking the panels at the adjacent edges at least in a direction perpendicular to the upper side and in a direction parallel to the upper side but perpendicular to the adjacent first and second edges in their joined position, the first and second joining members being provided with at least one deformable locking element which is deformed, during said joining, from a first position with a first shape allowing the first and second joining members to be joined, to a second position with a second shape in which it locks the first and second joining members to each other at least in said direction parallel to the upper side, the second shape of the locking element being different than the first shape, wherein the locking element is provided on one of the first and second joining members and comprises a first locking surface co-operating with a second locking surface on the other of said first and second joining members for locking the two panels to each other to prevent the panels from moving away from each other in a direction parallel to the upper side, and wherein the second locking surface on the other of the first and second joining members is located within a recess and inclined such that the second locking surface is facing away from the seam in the joined position of the panels.

2. The floor panel assembly of claim 1, wherein the locking element is provided with hinges, and in the joined position, one edge of the locking element being fixed in a stationary position to one of the first and second joining members in and from the first position to the second position and the other edge being provided with said first locking surface, and wherein the other edge of the locking element comprise a hook bearing said first locking surface, whereas the other of the first and second joining members comprises a recess including said second locking surface.

3. The floor panel assembly of claim 1, wherein the first locking surface of the locking element extends substantially parallel to the direction in which the first and second joining members are joined to each other, when in its first position.

4. The floor panel assembly of claim 1, wherein the locking element comprises a control portion configured to co-operate with a control portion on the other of the first and second joining members in order to control movement of the locking element from the first to the second position.

5. The floor panel assembly of claim 4, wherein the control portion of the locking element is at a distance from an underlying portion of the one of said first and second joining members in the first position, whereas a portion between the locking surface and the control portion is substantially adjacent to the underlying portion of the one of said first and second joining members.

6. The floor panel assembly of claim 1, wherein the first and second joining members are configured as a male and female joining member, the locking element being attached to the female joining member, and wherein the female joining member comprises a depression which is at least locally covered by the locking element, the male joining member comprising a protrusion configured to co-operate with the locking element at a position above the depression of the female joining member.

7. The floor panel assembly of claim 6, wherein the protrusion of the male joining member has a recess bearing the second locking surface on its side remote from the seam and at a distance from a crest of the protrusion, and wherein the locking element is provided with at least one hinge which is positioned to co-operate with a crest of the protrusion of the male joining member.

8. The floor panel assembly of claim 1, wherein the locking element is constructed such that a force is required to move the locking element between the first and second positions and through an intermediate position where a pretension in the locking element is reversed.

9. The floor panel assembly of claim 1, wherein a plurality of locking elements is provided along the respective edge, and wherein the locking elements are interconnected to each other to form a locking strip.

10. The floor panel assembly of claim 9, wherein the locking strip includes a stop for the other of said first and second joining members and determines the position of the other of said first and second joining members in the second position of the locking element.

11. The floor panel assembly of claim 1, wherein the first and second joining members are vertical joining members and the first and second joining members are joined to each other by a mainly vertical movement of the respective panel edges towards each other.

12. The floor panel assembly of claim 6, wherein the protrusion of the male joining member has a recess bearing the second locking surface on its side remote from the seam and at a distance from a crest of the protrusion, wherein the locking element is provided with at least one hinge which is positioned to co-operate with a crest of the protrusion of the male joining member, and wherein the locking element is locking the male joining member in a horizontal direction, and the first and second joining members being provided with third and fourth locking surfaces having at least a horizontal component to lock the first and second joining members in a direction perpendicular to the upper side.

13. The floor panel assembly of claim 1, wherein the locking element is provided with a first locking surface directed substantially towards the seam and moving towards the seam when the locking element is moved from the first to the second position.

14. The floor panel of claim 12, wherein the male joining member is provided with a tongue having on its upper surface the third locking surface and the female joining member having an undercut bearing the fourth locking surface.

15. The floor panel assembly of claim 12, wherein the third and fourth locking surfaces are substantially adjacent to the surfaces forming the seam between the panels.

16. A floor panel assembly comprising sheet-shaped floor panels, which floor panels are provided with a plurality of edges, a lower side and an upper side, whereby the floor panels are configured to be joined by joining members, each floor panel being provided on at least a first edge with a first joining member and, on a second edge, with a second joining member, the first and second joining members of two panels being configured to be joined by a movement of the two panels with their first and second edges towards to each other such that in a joined position the panels meet each other near their upper side along a seam and the first and second joining members locking the panels at the adjacent edges at least in a direction perpendicular to the upper side and in a direction parallel to the upper side but perpendicular to the adjacent first and second edges in their joined position, the first and second joining members being provided with at least one locking element the shape of which changes during said joining, from an unjoined position wherein the first and second joining members are not joined, to the joined position wherein the first and second joining members are locked to each other, said locking element having a first end engaging at least one surface of one of said first and second panels to fix the first end in a stationary position to said one of said first and second joining members in the unjoined position and wherein the first end is in the same stationary position when the first and second joining members are in the joined position and, the locking element having a second end joined to the first end with at least two flexible hinges, and in the joined position, the second end of the locking element is in engagement with the other one of said first and second joining members and moves when the shape of the locking element changes from the unjoined to the joined position.

17. The floor panel assembly of claim 16, wherein the first and second joining members are configured as a male and female vertical joining member, the locking element being attached to the female vertical joining member.

18. The floor panel assembly of claim 17, wherein the female vertical joining member comprises a lip protruding substantially parallel to and from the lower side of the panel at the first edge, said lip having a depression which is at least locally covered by the locking element, said depression having an upright wall near the free end of the lip and the locking element being adjacent to this upright wall when the locking element is in its second position.

19. A floor panel assembly comprising sheet-shaped floor panels, which floor panels are provided with edges, a lower side and an upper side, whereby the floor panels are configured to be joined by joining members, each floor panel being provided on at least a first edge with a first joining member and, on an opposite second edge, with a second joining member, the first and second joining members being configured to be joined by a movement of two panels with their first and second edges towards to each other such that in a joined position the panels meet each other near their upper side along a seam, the first and second joining members locking the panels at the adjacent edges at least in a direction perpendicular to the upper side and in a direction parallel to the upper side but perpendicular to the adjacent first and second edges in their joined position, the first and second joining members being provided with at least one locking element the shape of which changes during said joining, from an unjoined position allowing the first and second joining members to be joined, to the joined position in which it locks the first and second joining members to each other, said locking element having a first terminal end fixed to at least one surface of one of the first and second joining members in a stationary position in said one of the first and second joining members in the joined position and wherein the first terminal end is in the same fixed stationary position in said one of the first and second joining members in the unjoined position, a locking portion at a second end remote from the first end and a control portion located between and joined to each of the first and second ends with flexible hinges thinner than the first and second ends and the control portion.

20. The flooring element of claim 19, wherein the control portion of the locking element is at a distance from an underlying portion of the first joining member in the first position, whereas a portion of the locking element between the locking portion and the control portion is substantially adjacent to the underlying portion of the first joining member.

21. The floor panel assembly of claim 20, wherein in the second position of the locking element the control portion is adjacent to the underlying portion of the first joining member.

22. A floor panel assembly comprising sheet-shaped floor panels with a generally rectangular shape, which floor panels are provided with edges, a lower side and an upper side, whereby the floor panels are configured to be joined by joining members, each floor panel being provided on at least a first edge with a first vertical joining member and, on an opposite second edge, with a second vertical joining member, the first and second vertical joining members being configured to be joined by a mainly vertical movement of two panels with their first and second edges adjacent to each other such that in a joined position the panels meet each other near their upper side along a seam, the first and second vertical joining members locking the panels at the adjacent edges at least in a direction perpendicular to the upper side and in a direction parallel to the upper side but perpendicular to the adjacent first and second edges in their joined position, the first and second vertical joining members being provided with at least one deformable locking element which changes shape, during said joining, from a first shape in a first position allowing the first and second vertical joining members to be joined, to a second shape, different than the first shape, in a second position in which it locks the first and second vertical joining members to each other, the movement of the locking element from the first position to the second position is substantially in one direction only, starting from a substantially horizontal position of a main portion of the locking element that extends from one terminal end of the locking element secured a surface of one of the joining members in a fixed position in the first position and wherein the terminal end is in the same fixed position when in the second position.

23. The floor panel assembly of claim 22, wherein a first edge of the locking element is fixed to one of the first and second vertical joining members in a stationary position in and from the first position to the second position, and wherein the other of said first and second vertical joining members is provided with a control portion to at least start the deformation of the locking element, said control portion being positioned such that during joining of said first and second edges the control portion comes into contact with the locking element at a position between the first edge and a second edge remote from the first edge, thereby loading the locking element substantially perpendicularly to the main portion.

24. A floor panel assembly comprising sheet-shaped floor panels with a generally rectangular shape, which floor panels are provided with edges, a lower side and an upper side, whereby the floor panels are configured to be joined by joining members, each floor panel being provided on at least a first edge with a first vertical joining member and, on an opposite second edge, with a second vertical joining member, the first and second vertical joining members being configured to be joined by a mainly vertical movement of two panels with their first and second edges adjacent to each other such that in a joined position the panels meet each other near their upper side along a seam, the first and second vertical joining members locking the panels at the adjacent edges at least in a direction perpendicular to the upper side and in a direction parallel to the upper side but perpendicular to the adjacent first and second edges in their joined position, the first and second vertical joining members being provided with at least one locking element which changes shape during said joining, from a first shape in an enjoined position allowing the first and second vertical joining members to be joined, to a second shape, different than the first shape, in the joined position in which it locks the first and second vertical joining members to each other at least in said direction parallel to the upper side through engagement a locking surface on the other of the first and second joining members which is located within a recess and inclined such that the second locking surface is facing away from the seam in the joined position of the panels.

25. The floor panel assembly of claim 24, wherein a first edge of the locking element is fixed to one of the first and second vertical joining members in a stationary position in and from the first position to the second position and wherein the locking element comprises a locking surface flexibly joined to the first edge and co-operating with a locking surface on the other of the first and second vertical joining members.

26. The floor panel assembly of claim 24, wherein the first and second vertical joining members are configured as a male and female vertical joining member, the locking element being attached to the female vertical joining member.

27. The floor panel assembly of claim 26, wherein the locking element is locking the first male vertical joining member in horizontal direction, and the first and second vertical joining members being provided with third and fourth locking surfaces having at least a horizontal component to lock the first and second vertical joining members in a direction perpendicular to the upper side.

28. The floor panel assembly of claim 27, wherein the locking element is provided with a first locking surface directed substantially towards the seam and moving towards the seam when the locking element is moved from the first to the second position.

29. The floor panel of claim 28, wherein the male vertical joining member is provided with a tongue having on its upper surface the third locking surface and the female vertical joining member having an undercut bearing the fourth locking surface.

30. The floor panel assembly of claim 24, wherein the locking element being provided on one of the first and second vertical joining members and comprising a control portion between its ends and a first locking surface co-operating with a second locking surface on the other of the first and second joining members to effect said lock in said direction parallel to the upper side, the locking element being constructed and positioned such that a downward movement of the control portion is transferred into a movement of the first locking surface in the direction of the seam.

31. The floor panel assembly of claim 24, wherein the locking element and said one of said first and second joining members include at least one of dimensioning the locking element such that a force is required to move the locking element between the first and second positions, and providing the locking element and said one of the first and second joining members with engagement surfaces engaging each other in the second position of the locking element.

32. A floor panel assembly comprising sheet-shaped floor panels, which floor panels are provided with edges, a lower side and an upper side, whereby the floor panels are configured to be joined by joining members, each floor panel being provided on at least a first edge with a first joining member and, on an opposite second edge, with a second joining member, the first and second joining members being configured to be joined by a movement of two panels with their first and second edges moving towards to each other such that in a joined position the panels meet each other near their upper side along a seam, the first and second joining members locking the panels at the adjacent edges at least in a direction perpendicular to the upper side and in a direction parallel to the upper side but perpendicular to the adjacent first and second edges in their joined position, the first and second joining members being provided with at least one deformable locking element which changes shape during said joining, from a first shape in an unjoined position allowing the first and second vertical joining members to be joined, to a second shape, different than the first shape, in the joined position in which it locks the first and second joining members to each other in both said directions parallel and perpendicular to the upper side, and wherein the locking element is fixedly secured on one terminal end to a surface on one of the first and second vertical joining members and comprises a movable locking surface flexibly joined to said one terminal end and co-operating with a locking surface defining a portion of a recess on the other of the first and second vertical joining members in order to provide said lock in both said directions parallel and perpendicular to the upper side and wherein said one terminal end is retained in a same location on one of the first and second vertical joining members in an unjoined position of the first and second joining members and in the joined position the first and second joining members.

33. The floor panel assembly of claim 32, wherein the second locking surface on the other of the first and second joining members is inclined and is facing away from the seam in the joined position of the panels.

34. A floor panel assembly comprising sheet-shaped floor panels with a generally rectangular shape, which floor panels are provided with edges, a lower side and an upper side, whereby the floor panels are configured to be joined by joining members, each floor panel being provided on at least a first edge with a first vertical joining member and, on an opposite second edge, with a second vertical joining member, the first and second vertical joining members being configured to be joined by a mainly vertical movement of two panels with their first and second edges adjacent to each other such that in a joined position the panels meet each other near their upper side along a seam, the first and second vertical joining members locking the panels at the adjacent edges at least in a direction perpendicular to the upper side and in a direction parallel to the upper side but perpendicular to the adjacent first and second edges in their joined position, the first and second vertical joining members being provided with at least one deformable locking element which is deformed, during said joining, from a stable first position allowing the first and second vertical joining members to be joined, to a different second position in which it locks the first and second vertical joining members to each other at least in said direction parallel to the upper side, the locking element comprises a terminal end being secured to and engaging at least one surface on one of the first and second vertical joining members such that the terminal end is in a fixed stationary position on said one of the first and second vertical joining members with a control portion flexibly joined to the terminal end, wherein the terminal end is in the fixed stationary position when the panels are in an unjoined position and the end is in the same stationary position when the panels are in the joined position, the control portion being further flexibly joined to a first locking surface co-operating with a second locking surface on the other of the first and second vertical joining members to effect said lock in said direction parallel to the upper side, the locking element being constructed and positioned such that a downward movement of the control portion is transferred into a movement of the first locking surface in the direction of the seam.

* * * * *